United States Patent [19]

Travaglini et al.

[11] 3,936,217

[45] Feb. 3, 1976

[54] INSPECTION PORT FOR TURBINES

[75] Inventors: Michael J. Travaglini, Aston; Joseph F. Abbruzzesi, Swarthmore, both of Pa.

[73] Assignee: Westinghouse Electric Corporation, Pittsburgh, Pa.

[22] Filed: Jan. 31, 1975

[21] Appl. No.: 546,067

[52] U.S. Cl. ..... 415/118

[51] Int. Cl.[2] ..... F01D 25/00

[58] Field of Search ..... 415/118; 73/345; 60/39.75

[56] References Cited

UNITED STATES PATENTS

| | | | |
|---|---|---|---|
| 3,362,160 | 1/1968 | Bourgeois | 415/118 |
| 3,841,764 | 10/1974 | Snell | 415/118 |
| 3,845,661 | 11/1974 | Hollweck et al. | 73/349 |
| 3,849,893 | 11/1974 | Ormsby | 415/118 |

FOREIGN PATENTS OR APPLICATIONS

| | | | |
|---|---|---|---|
| 373,940 | 6/1932 | United Kingdom | 415/118 |
| 1,100,634 | 11/1965 | United Kingdom | 415/118 |

*Primary Examiner*—Henry F. Raduazo
*Attorney, Agent, or Firm*—F. J. Baehr, Jr.

[57] ABSTRACT

An inspection port structure is provided for turbines to allow examination of interior regions of the turbine for possible damage or deleterious conditions in the flow path. A sealing member is provided in the port with spring means for locking the sealing member in place during normal operation. The sealing member can readily be removed when desired, to permit the insertion of a suitable instrument for internal inspection, and can then be easily replaced in a manner which reliably reestablishes the necessary seal.

5 Claims, 5 Drawing Figures

INSPECTION PORT FOR TURBINES

BACKGROUND OF THE INVENTION

The present invention relates to the inspection of turbines, and particularly axial flow gas turbines in which the condition of interior regions of the turbine must be monitored or inspected at regular intervals.

In such turbines it is necessary to make regular inspections to determine if any deleterious conditions exist in the flow path of the hot gases through the turbine, such as erosion of the blades, or if any damage has been caused by foreign particles which may have entered the flow path. Such inspections may, of course, be made by partial disassembly of the turbine structure but this is an expensive and time-consuming operation which is to be avoided if possible. Satisfactory inspections can also be made by means of inspection ports which provide access to the interior of the turbine at the desired locations and permit insertion of a borescope, or other suitable instrument, for examining the condition of the turbine. Such inspection ports must, of course, be closed and sealed during operation to prevent escape of the hot pressurized gas flowing through the turbine, or the entrance of cool air or of foreign particles such as dirt. The sealing means must effectively and reliably seal the opening into the turbine and must be easily accessible from the outside of the turbine in a manner to facilitate disassembly and removal of the sealing means when an inspection is to be made. The sealing means must also be such that after the inspection is completed, it can be readily replaced and reassembled in the inspection port to again seal the access opening with a seal which effectively reproduces the original seal.

SUMMARY OF THE INVENTION

In accordance with the present invention, there is provided an inspection port and seal assembly for a turbine which comprises an elongated tubular member extending through the casing and accessible from the outside of the turbine. The tubular member is aligned with an inner opening giving access to the interior region of the turbine which is to be inspected, and an elongated sealing member extends through the tubular member and engages the opening to seal it. The outer end of the tubular member is closed by a removable cap or closure member and sealing pressure is applied to the sealing member by a compression spring disposed between the sealing member and the closure member. The closure member has locking pins engaging slots in the tubular member in such a manner that when the cap is in locking position, the spring also applies pressure to the cap in a direction to positively retain it in place. In this way, a relatively simple structure is provided which can readily be removed when an inspection is to be made and which can easily be replaced in a manner which exactly reproduces the original sealing engagement, since both the seal and the locking of the cap are effected by the compression spring which applies axial forces to both members.

BRIEF DESCRIPTION OF THE DRAWING

The invention will be more fully understood from the following detailed description, taken in connection with the accompanying drawing, in which.

DESCRIPTION OF THE PREFERRED EMBODIMENT

Figure 1:
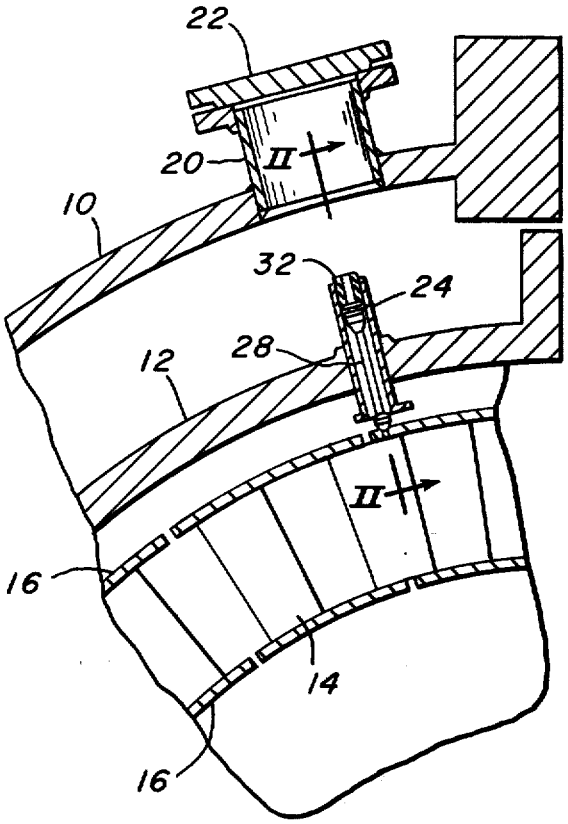
FIG. 1 is a fragmentary transverse sectional view of a gas turbine illustrating the inspection port of the present invention.
Figure 3:
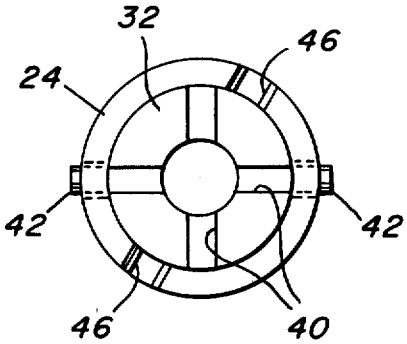
FIG. 3 is a top view of the inspection port with the closure cap in place.

The invention is shown in the drawing in an illustrative embodiment in an axial flow gas turbine, although it will be understood that the usefulness of the invention is not necessarily limited to any particular type of machine and it may be used in any turbine where inspection of an interior region is necessary.

The turbine itself may be of any usual type of construction and has not been illustrated in detail. The turbine is shown as having an outer casing 10 and an inner casing 12 which may be generally cylindrical or conical and which completely enclose the turbine. A row of stationary vanes or blades 14 is disposed between shrouds 16 inside the inner casing 12. The vanes 14 may be of any suitable or known type for cooperation with an adjacent row of moving vanes or blades carried on a rotor (not shown) in the usual manner. The outer shroud 16 may be attached to the inner casing 12 in any desired or usual manner by suitable means generally indicated at 18.

As previously discussed, it is necessary to inspect the interior of a turbine at regular intervals for the presence of damage such as blade erosion or other deleterious effects due to the hot, pressurized gas stream, or to foreign particles which may be carried into the turbine, or other causes. It would, of course, be possible to make such inspections by partially disassembling the turbine and then reassembling after completion of the inspection, but this is a very costly and time-consuming operation which is to be avoided if at all possible. In accordance with the present invention, such disassembly is avoided by the use of inspection ports extending through the casing means and permitting access to the interior of the turbine so that the necessary inspections can be carried out without diassembly. Such an inspection port must, of course, be adequately sealed during normal operation to contain the hot pressurized gas flowing through the turbine, and must be capable of relatively simple opening and disassembly of the sealing means to permit the inspection to be made and easy reassembly after completion of the inspection with a reproducible sealing effect so that the seal is restored to its original effectiveness.

The present invention provides an inspection port and seal assembly which meets these requirements. As shown in the drawing, an access port is provided in the outer casing 10 which consists of a cylindrical port member 20 welded or otherwise sealed in the casing 10 and normally closed by a plate 22 which may be bolted or otherwise secured to the port 20, with suitable gaskets or other sealing means to keep it effectively sealed in normal operation. The inspection port consists of a tubular member 24 which may be made of stainless steel tubing, or other suitable material, and which extends through the inner casing 12 and is welded or otherwise secured in place therein. The tube 24 is coaxial with the port 20 and is aligned with an inspection opening 26 in the outer shroud 16 of the stationary vane assembly. The ports 20 and 24 and the opening 26 are all aligned on the same axis 27, as shown, so that when they are open, a borescope or other instrument for performing the internal inspection may be inserted through them into the region of the stationary vane assembly.

Figure 2:
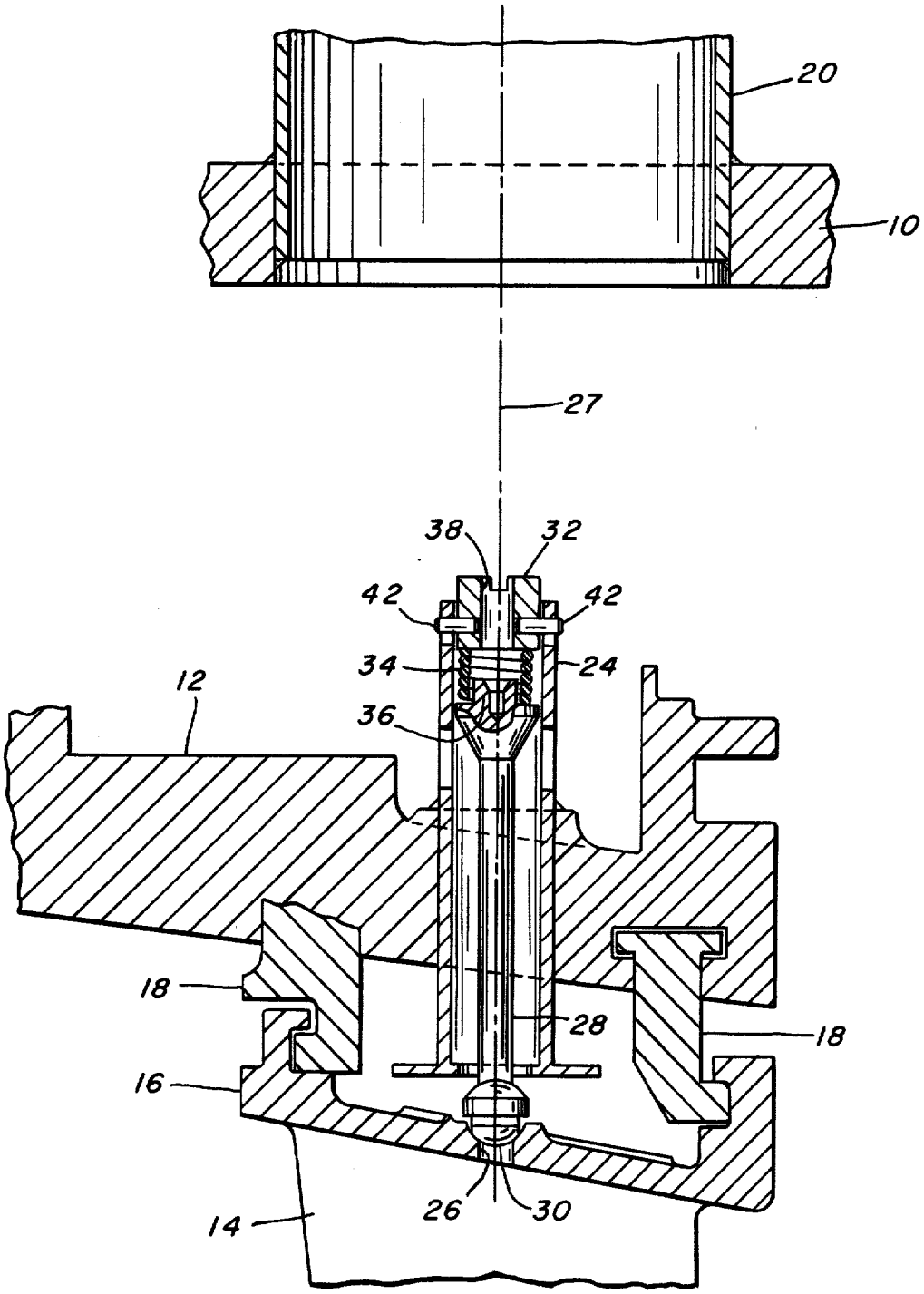
FIG. 2 is a longitudinal view substantially on the line II—II of FIG. 1 and on a somewhat larger scale.

During normal operation, the opening 26 must be effectively sealed to prevent escape of the hot gas flowing through the turbine, or leakage of cool air into the flow path. For this purpose, an elongated sealing member 28 is disposed in the tube 24. The member 28 may be made of steel rod, or other suitable material, with a spherical lower end indicated at 30 which engages a corresponding spherical seat surrounding the opening 26, so that a good sealing engagement is made and an effective seal is produced when sufficient pressure is applied to the member 28. The upper or outer end of the tube 24 is closed by a cap or closure member 32 locked in place by means described below during normal operation. A compression spring 34 is disposed between the closure cap 32 and the upper end of the sealing member 28 and may be supported in place by a reduced section 36 at the upper end of the member 28. When the cap 32 is in place, the spring 34 is compressed, as can be seen in FIG. 2, and applies heavy sealing pressure to the sealing member 28 to effectively seal the opening 26.

Figure 4:
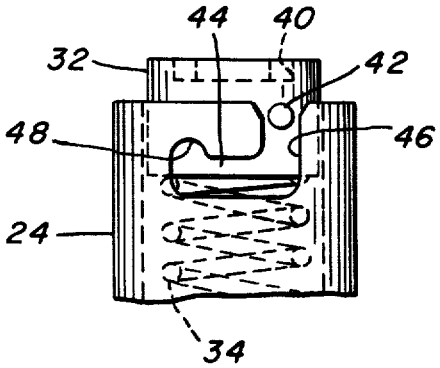
FIG. 4 is a side view of the outer end of the inspection port with the closure cap in position to be inserted.
Figure 5:
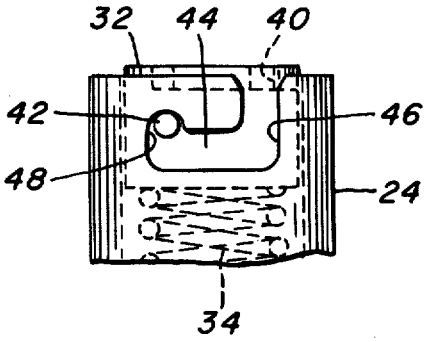
FIG. 5 is a similar view showing the cap in closed and locked position in the inspection port.

The closure cap 32 is locked in the closed position by means of the spring 34 as shown particularly in FIGS. 4 and 5. The cap 32 itself may be a cylindrical member of suitable size to fit in the tube 24 and has a central bore 38 with transverse slots 40 extending across the top. Two oppositely-extending locking pins 42 are provided in the cap 32 for locking it in place. As shown in FIGS. 4 and 5, the upper end of the tube 24 has a slot 44 on each side thereof for receiving the pins 42. Each of the slots 44 has an entrance portion 46 extending longitudinally to the end of the tube 24 and has a circumferential portion wich terminates in a recess 48 of proper size to receive one of the pins 42. In assembling the sealing structure in the inspection port, the member 28 is put in position engaging in the opening 26 with the spring 34 in place at the outer end of the member 28. The cap 32 is then inserted in the end of the tube 24 with the locking pins 42 in the entrance sections 46 of the slots 44, as shown in FIG. 4. The cap 32 is then pressed downward, compressing the spring 34, and turned to the position shown in FIG. 5, the pins 42 moving through the slots and engaging the recesses 48. The compressed spring 34 forces the cap 32 into the position shown where it is positively locked in place. In this position, it will be seen that the spring 34 applies axial forces in both directions, that is, a force is applied to the sealing member 28 to effectively seal the opening 26, and a similar but opposite force is applied to the cap 32 to lock it in place with the pins 42 engaging in the recesses 48.

It will be seen that an effective sealing means is thus provided for the inspection port. When it is desired to inspect the interior of the turbine, the plate 22 is first removed to provide access to the inspection port itself. The cap 32 is then removed from the tube 24 by inserting a suitable tool in the slots 40, pressing down on the cap 32 and rotating it sufficiently to allow the pins 42 to move to the entrance slots 46. The spring 34 then moves the cap 32 upward and the cap and sealing member 28, with the spring 34, are easily removed from the tube 24, permitting access to the opening 26 for insertion of a borescope or other instrument. After the inspection has been completed, the inspection port is easily and quickly reclosed by reassembling the sealing member 28 and cap 32 in the tube 24 in the manner described above, and replacing the plate 22. Thus, an inspection port is provided which can be quickly and easily opened and quickly and easily reassembled with a seal which exactly reproduces the original sealing conditions. It will be seen that only a small number of parts is needed which are easily handled and present no hazard to the normal operation of the turbine but which are quickly and easily removed and reassembled. The use of difficult and unreliable fastening means such as lock wires is avoided and a simple and effective closing and sealing means are provided.

What is claimed is:

1. In a turbine having casing means, with an inspection port, the combination comprising an elongated tubular member extending through at least a part of the casing means in alignment with an opening giving access to the interior region to be inspected, an elongated sealing member extending through said tubular member and engaging said opening in sealing relation, a closure member substantially closing the outer end of the tubular member, and spring means in the tubular member disposed to apply sealing pressure to said sealing member and to apply a force to said closure member to positively retain it in place.

2. The combination defined in claim 1 including inner and outer casing members, said tubular member being supported in the inner casing member and extending therethrough, and access means in the outer casing member for providing access to the outer end of the tubular member.

3. The combination defined in claim 1 in which said closure member and said tubular member have interengaging elements, and said spring means is a compression spring disposed between the sealing member and the closure member.

4. The combination defined in claim 3 in which the closure member has pins thereon extending transversely of the tubular member, and the tubular member has slots for receiving said pins, each of said slots having an entrance portion extending to the end of the tubular member and a locking portion for engagement by a pin upon rotation of the closure member.

5. The combination defined in claim 4 including access means in alignment with said tubular member in said opening, said access means permitting access to the tubular member for removal of the closure member and the sealing member.

* * * * *